US008125400B2

(12) United States Patent
Bezuidenhout et al.

(10) Patent No.: US 8,125,400 B2
(45) Date of Patent: Feb. 28, 2012

(54) COMPACT ANTENNA FEED ASSEMBLY AND SUPPORT ARM WITH INTEGRATED WAVEGUIDE

(75) Inventors: Petrus Bezuidenhout, Port Coquitlam (CA); Leonard Albert Russell, Delta (CA); Jesse Tyrel Glassford, Richmond (CA)

(73) Assignee: Norsat International Inc., Richmond (CA)

( * ) Notice: Subject to any disclaimer, the term of this patent is extended or adjusted under 35 U.S.C. 154(b) by 304 days.

(21) Appl. No.: 12/271,742

(22) Filed: Nov. 14, 2008

(65) Prior Publication Data

US 2010/0123636 A1 May 20, 2010

(51) Int. Cl.

| | |
|---|---|
| ***H01Q 13/02*** | (2006.01) |
| ***H01Q 19/12*** | (2006.01) |
| ***H01Q 15/24*** | (2006.01) |
| ***H01P 5/00*** | (2006.01) |

(52) U.S. Cl. ..... 343/781 R; 343/756; 343/840; 333/137

(58) Field of Classification Search ..... 342/153; 343/756, 781 R, 840; 455/328, 81; 324/84, 324/95; 333/137

See application file for complete search history.

(56) References Cited

U.S. PATENT DOCUMENTS

| | | | | |
|---|---|---|---|---|
| 4,420,756 | A * | 12/1983 | Hamada et al. | 342/153 |
| 6,025,809 | A * | 2/2000 | Lane et al. | 343/772 |
| 6,118,412 | A * | 9/2000 | Chen | 343/756 |
| 6,181,293 | B1 * | 1/2001 | Muhlhauser et al. | 343/840 |
| 6,407,646 | B1 * | 6/2002 | Johnson | 333/1.1 |
| 2007/0075909 | A1 * | 4/2007 | Flynn et al. | 343/840 |
| 2008/0062056 | A1 * | 3/2008 | Hoferer | 343/776 |

* cited by examiner

*Primary Examiner* — Jacob Y Choi
*Assistant Examiner* — Amal Patel

(57) ABSTRACT

A feed assembly and feed support arm for parabolic antennas with circular or linear polarization is provided in a streamlined configuration. The feed assembly contains a septum polarizer with parallel transmit and receive ports, or a similarly configured ortho-mode transducer. Through a common waveguide transition, the ports connect to transmit and receive filters joined together in parallel to form a square-profile structure that serves as the feed support arm. The receive filter terminates in a low noise block downconverter while the transmit filter connects to a waveguide flange at the base of the reflector, which is the output port of an up-converter/power amplifier mounted behind the reflector. Alternatively, the power amplifier is integrated into the feed support arm, connecting to the rest of the transmitter behind the reflector.

11 Claims, 4 Drawing Sheets

PRIOR ART

COMPACT ANTENNA FEED ASSEMBLY AND SUPPORT ARM WITH INTEGRATED WAVEGUIDE

FIELD OF THE INVENTION

The invention relates to antenna feed and feed support arm assemblies, including those employed by single-offset antenna assemblies of microwave terminals.

BACKGROUND OF THE INVENTION

Portable communications systems that transmit high bit rate data have high performance demands. Such high performance systems include Satellite News Gathering (SNG) systems, systems for logging and transmitting data from remote exploration sites, and portable military communication systems. In order to achieve high performance while preventing undue interference to or from other systems, such communication systems generally employ an antenna with a suitably sized parabolic reflector. The most practical and least expensive option for such systems is a single-offset antenna in which the feed support arm (with the feed assembly at the top end) can be removed from the parabolic reflector to enhance portability.

FIG. 1 shows a conventional prior art portable satellite communications terminal unit. The unit has a base 106 that includes means for stabilizing the unit on a surface. The base also houses electronic components for processing incoming and outgoing communications signals. The distal end of an elongate support arm 104, commonly referred to in the art as a "boom," holds a feed horn 110. Throughout this disclosure and the claims, "distal" refers to structures along the feed arm and support arm at, near, or toward the feed horn; "proximal" refers to structures along the feed arm and support arm at, near, or toward the reflector or base.

The support arm is attached by its proximal end to a parabolic reflector 107, commonly referred to as a "dish." The support arm is shown in FIG. 1 attached to the top of reflector 107. Although this is typical, it is not uncommon to have the support arm attached to the bottom of the reflector or at other points about the periphery of the reflector.

A feed assembly 101 includes the feed horn 110 aimed at the reflector to collect incoming (down-link) received signals reflected from the reflector and to direct outgoing (up-link) transmitted signals to the reflector. The feed assembly also includes an exposed flexible guide 108 for conducting the transmit signal to the feed horn. A receive line 109 conducts receive signals from the feed assembly to the processing circuitry. As shown, a low noise block (LNB) downconverter 102 is often integrated into the receive signal pathway. FIG. 1 also shows a transmit amplifier 105 as typically attached to the back of the reflector 107.

A transmit filter 103A, when used, is often attached to the support arm as shown and runs generally parallel to the arm. Such a transmit filter is particularly important in cases where a high power transmit amplifier is used to meet the up-link requirements because high power transmit amplifiers typically produce a high amount of noise in the receive frequency band that passes through the receive filter. This noise interferes with the performance of the receiver unless preventive measures are taken. The transmit filter, if properly designed, will pass the transmit frequency band with minimum signal loss while suppressing the noise in the receive frequency band. However, in some of the lower frequency bands such as X-band and C-band, filters having sufficiently high performance are relatively large. Placing such a filter near the feed horn results in bulky, awkward structures that cause problems due to weight loading of the support arm and possibly wind loading caused by a large cross-sectional area. Partial obstruction of the signal radiated from the reflector may also occur. Thus the size of the transmit filter typically requires placing it alongside the feed support arm 104 with appropriate attachments to the arm. However, this arrangement significantly complicates assembly and disassembly of the unit in field conditions.

FIG. 2 shows a typical conventional feed assembly in more detail. As shown, the feed assembly typically includes a feed horn 201, a polarizer 202 (in cases of circular polarization), an ortho-mode transducer (OMT) 203, and LNB 102 with an associated receive filter 204. In some cases the receive filter employed is too large to be incorporated into the feed assembly and, together with the LNB 102, is placed outside the feed assembly.

The OMT separates vertically and horizontally polarized signals in the case of linear polarization. The two signals are physically accessed at two waveguide flanges oriented in different directions, as discussed below.

For circular polarization, either a polarizer 202 is placed between the feed horn 201 and the OMT 203, as shown, or a polarizer incorporating the OMT function is used. The latter category is well represented by septum polarizers. A number of patents can be found for various types of septum polarizers, such as U.S. Pat. No. 6,661,390 to Gau et al.; U.S. Pat. No. 6,507,323 to West et al.; U.S. Pat. No. 6,118,412 to Chen, and U.S. Pat. No. 6,724,277 to Holden et al.

FIG. 3 shows a typical septum polarizer 301 in cross-section. Feed horn 302 is connected to the distal end 301A of the septum polarizer. At the proximal end 301B of the septum polarizer are two ports. For instance, port 303 carries the linearly polarized transmit signal 304, which is gradually converted into a left-hand circularly polarized signal as it progresses along the septum to the distal end 301A. Similarly, a right-hand circularly polarized signal entering the distal end of the polarizer is gradually converted along the septum into a linearly polarized receive signal 306 emerging at port 305. Thus, septum 307 converts circular to linear polarization (or vice versa) and separates the transmit and receive signals at the proximal end, hence the name septum polarizer. For the purpose of comprehending the present invention it is important to note that the septum of the prior art septum polarizer is limited just to the polarizer, because the two signals diverge at the proximal end of the septum polarizer into separate waveguides 308, 309, the axes of which often subtend an angle of 180°, as shown in the figure.

As a general rule, the two ports of a septum polarizer are oriented in different directions, usually opposite each other as shown in FIG. 3. While this conventional design is convenient for physical separation of transmit and receive components, it also contributes to a bulky feed assembly in antennas, particularly those used for the lower microwave bands such as X-band and C-band.

As noted above, the prior art devices have a number of disadvantages and problems, particularly with respect to portable units used in the field. Many of these disadvantages and problems are related to the fact that waveguides are handled separately. As a result the feed assemblies have exposed waveguide adapters, waveguide filters, receive-lines, and bulky opposing polarizer ports. These exposed structures on the end of the support arm produce significant weight and wind loading on the arm. In addition, external transmit filters attached to the support arm increase the complexity and time of assembly and disassembly and increase the risk of damage should the unit be knocked over by wind or other forces.

Although all of these problems have not hitherto been resolved in a single device, there have been ad hoc attempts to resolve some of them. For instance, an attempt to improve the mechanics of the feed support arm is disclosed by Canadian patent 2,424,774 to Russell et al, which describes a portable satellite terminal for Ku-band operation in which the transmit filter is contained within a hollow support arm, rather than using the more conventional placement beside the arm. This arrangement is shown in FIG. 2 in which the hollow arm 104 houses the alternative transmit filter 103B. The support arm connects to either the reflector or the base by a flange or other suitable connector means. This allows the integrated support arm and filters to be attached or removed as a single unit.

Another example of attempts to integrate various functions is shown in U.S. Pat. No. 5,905,474 to Ngai et al. wherein a single, appropriately bent waveguide is used to provide both the signal connection to the feed assembly and mechanical support (i.e. feed support arm). However, Ngai does not disclose integrated waveguides and filters. In U.S. Pat. No. 5,708,447 to Kammer et al., two bent waveguides running in parallel are used in a similar way to achieve a similar result. This approach enables both a transmit and receive function with different polarizations or a dual receive only (or dual transmit only) function with different polarizations. But again, there is no disclosure of integration of the waveguides or the filters, nor of any means for integrating multiple waveguides into a single structure that also includes transmit and/or receive filters.

Finally, there have been attempts to place some of the RE front end electronics into the feed support arm; however, these attempts have so far been limited to small receive components such as mixer/amplifiers and either microstrip or coaxial filters. One example of this approach is U.S. Pat. No. 5,523,768 to Hemmie et al. uses a hollow arm containing a mixer/amplifier and a coaxial filter but no waveguide components.

In view of the functional and structural limitations of the present art, what is needed is a rugged, high performance, high speed portable communications system for transmission and reception of data and/or video communications in which the components of the feed assembly and its support arm are unobtrusively integrated into a single streamlined structure that is free of exposed waveguides and filters and that minimizes weight and wind loading to the support arm.

SUMMARY OF THE INVENTION

This invention is a novel, multiple-integrated feed assembly and support arm of the type used by, for instance, single-offset parabolic antennas. The feed assembly includes a waveguide integrator (WGI), which combines two or more waveform pathways into a single, integrated waveguide structure. The WGI may be, for instance, an OMT or a septum polarizer modified for parallel arrangement of transmit and receive ports. The WGI has a transition portion for effectuating the transition of two or more waveform pathways into parallel waveguides integrated into a single structure, such as a waveguide or waveguide adapter or support arm having an internal separating wall or partition. Preferably the ports and the waveguide structure have square cross-sections. A flange may be used for mating the WGI and the integrated waveguide structure.

Individual WGI ports may be functionally continuous with transmit and receive filters joined together in parallel to also form a square-profile structure that serves as a feed support arm. In such embodiments, the receive filter terminates in an LNB while the transmit filter connects to a transmitter through a connector incorporating a waveguide flange at the base or at the bottom of the reflector. Alternatively, a specially designed power amplifier is integrated into the support arm and communicates with the rest of the transmitter circuitry housed behind the reflector.

BRIEF DESCRIPTION OF THE DRAWINGS

The features and advantages of the invention will be apparent from the following detailed description taken in conjunction with the accompanying drawings, wherein.

DETAILED DESCRIPTION OF THE INVENTION

Figure 1:
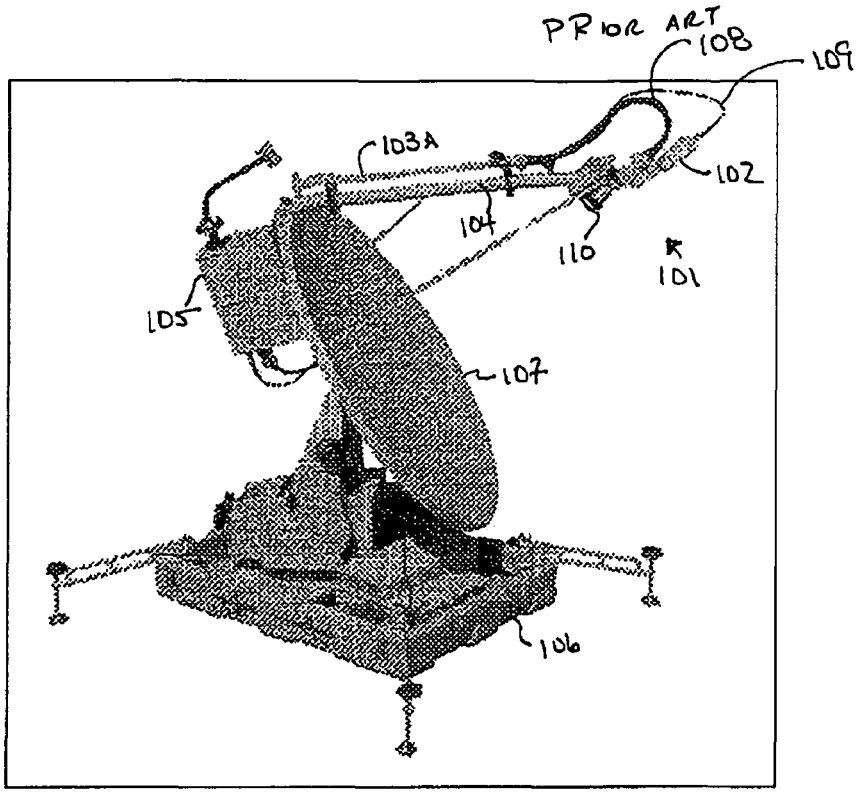
FIG 1. PRIOR ART
FIG. 1 is a perspective view of a prior art portable satellite communications terminal using a conventional antenna design, discussed above.
Figure 2:
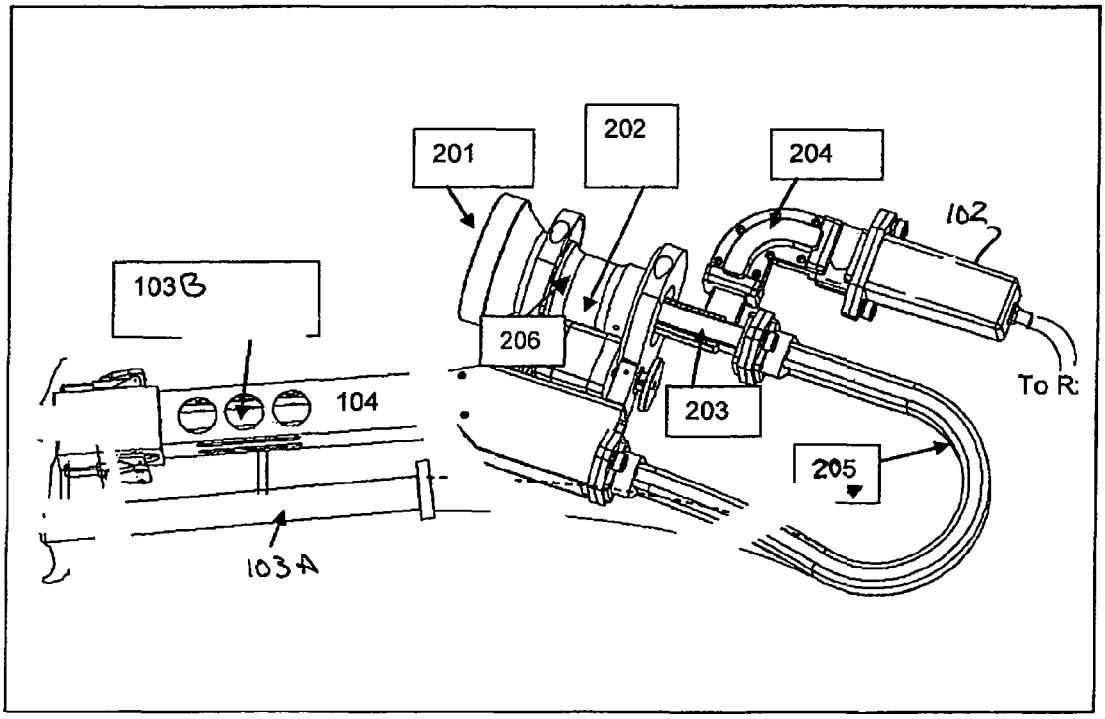
FIG. 2 is a side elevation of a prior art feed assembly, discussed above.
Figure 3:
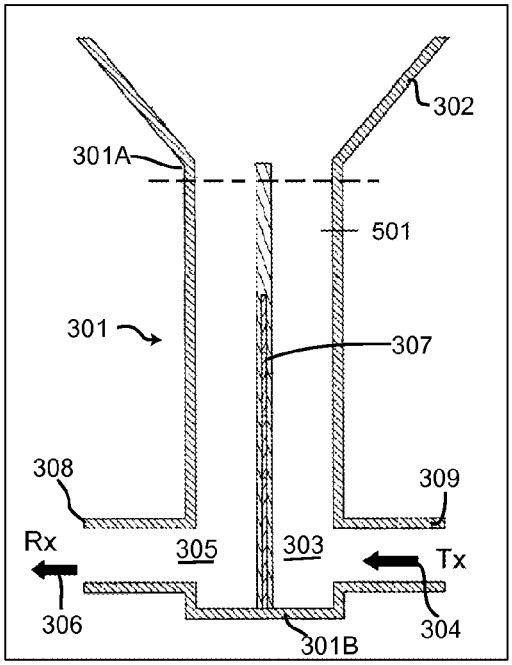
FIG. 3 is a cut-away view of a prior art feed horn and septum polarizer, discussed above.
Figure 4:
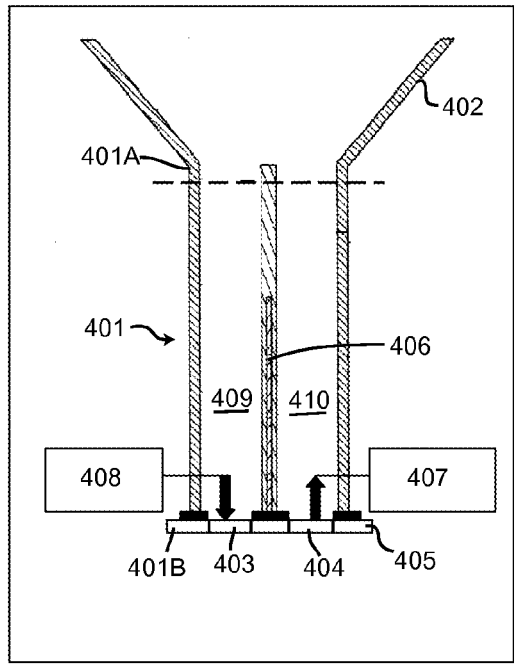
FIG. 4 is a cut-away view of a waveguide integrator (WGI) in the form of a modified septum polarizer.

FIG. 4 shows a polarizer 401 acting as a waveguide integrator (WGI), which WGI serves the function of integrating at least two waveform pathways into a single structure, as described herein. A WGI is defined as any structure, modification, or device that performs this integration function. In this embodiment the WGI is a modified septum polarizer that integrates transmit and receive pathways to and from a feed horn 402. At its distal end 401A, the septum polarizer is attached to and in communication with the feed horn. At its proximal end 401B, the septum polarizer has two ports 403, 404, which are arranged in parallel, in contrast to the typical prior art arrangement of having the ports mutually opposed and linear, as shown in FIG. 3. The two parallel ports of FIG. 4 form a square-profile interface equipped with a square flange 405 that allows each of the ports to communicate with one of the two waveguides (not shown) that are integrated into a single structure such as a waveguide adapter proximal to the septum polarizer, as shown in FIG. 5 and disclosed below.

A separator or partition 406 called a "septum" separates the two parallel transmit 410 and receive 409 spaces in which conversion from linear to circular or vice versa occurs as the signals travel along the septum. Arrows indicate transmit 407 and receive 408 signals, which are kept separate by the partition.

Figure 5:
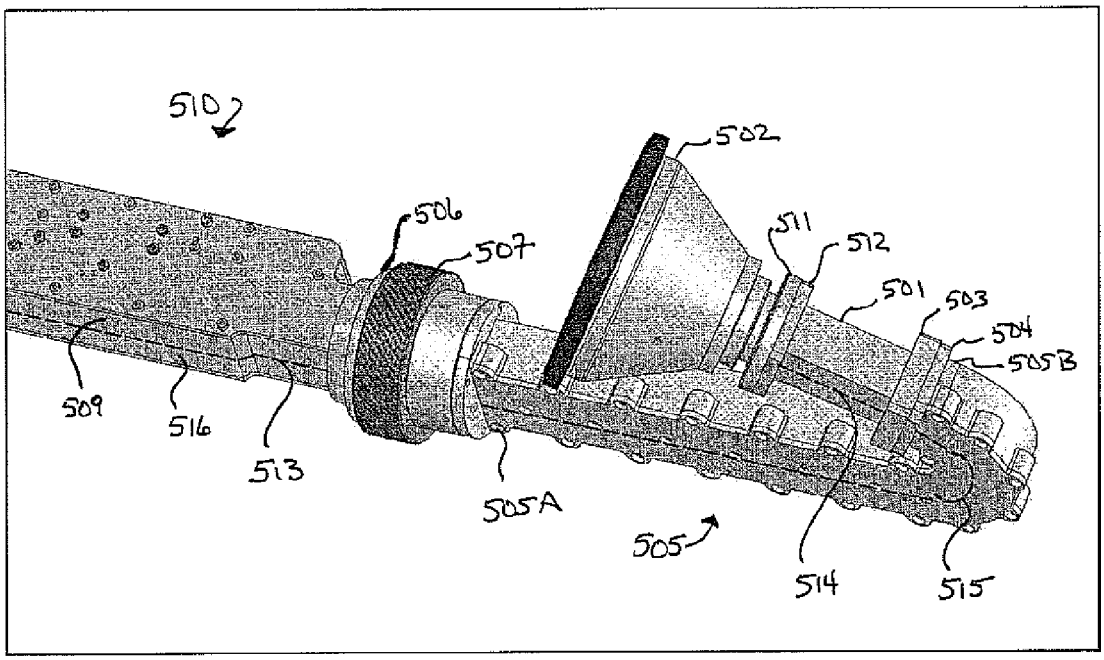
FIG. 5 is a perspective drawing of a feed assembly comprising a WGI in the form of a modified septum polarizer.

FIG. 5 shows an embodiment of the invention employing a streamlined, in-line arrangement of all parts of the feed assembly and boom that is possible as a result of using a WGI to integrate the waveguides into a single structure. In this embodiment the WGI is a modified septum polarizer 501 of the type, for instance, disclosed above in relation to FIG. 4. The embodiment shown in FIG. 5 is for circular polarization.

The modified septum polarizer 501 is oriented toward and communicates with the feed horn 502 by means of a connector that connects the distal end of the WGI to the feed horn. In the present embodiment, this connector includes mating flanges 511 and 512. The septum polarizer has a septum or partition 514, which separates the signals within the polarizer. At its proximal end, the septum polarizer has at least two parallel ports, which communicate with the distal end 505B of waveguide adapter 505 by means of a connector. In the present embodiment, this connector includes square flanges 503 (on the polarizer side) and 504 (on the adapter side). The proximal end 505A of waveguide adapter 505 is connected to the distal end of support arm 510 by means of a connector, such as circular mating-flanges 506 and 507.

This waveguide adapter differs from prior art adapters in that its rigidity is enhanced by a square cross-section, and it encompasses two or more internal waveguides (typically, transmit and receive) separated by an internal partition 515 that runs from the distal end to the proximal end of the waveguide adapter. This is possible because the septum polarizer acts as a WGI to integrate the two waveguides into the unitary structure of the waveguide adapter. Although only two waveguides are shown in the drawing, after reading this disclosure the advantages and means of adapting the device to accommodate multiple waveguides will become obvious to those skilled in the art.

Preferably support arm 510, like waveguide adapter 505, has a square-profile. The support arm may house two or more internal waveguides separated by an internal partition 513, which internal partition is functionally a continuation of partition 515 and partition 514, thereby producing two waveguides that are continuous from the distal end of the WGI to the proximal end of the support arm. Alternatively, support arm 510 may house transmit filter 509 and receive filter 516. The mating flanges 507 and 506 contain corresponding waveguide flanges internally (not shown) for maintaining functional continuity of the transmit and receive filters or the waveguides in support arm 510 with the waveguides in the adapter 505.

Figure 6:
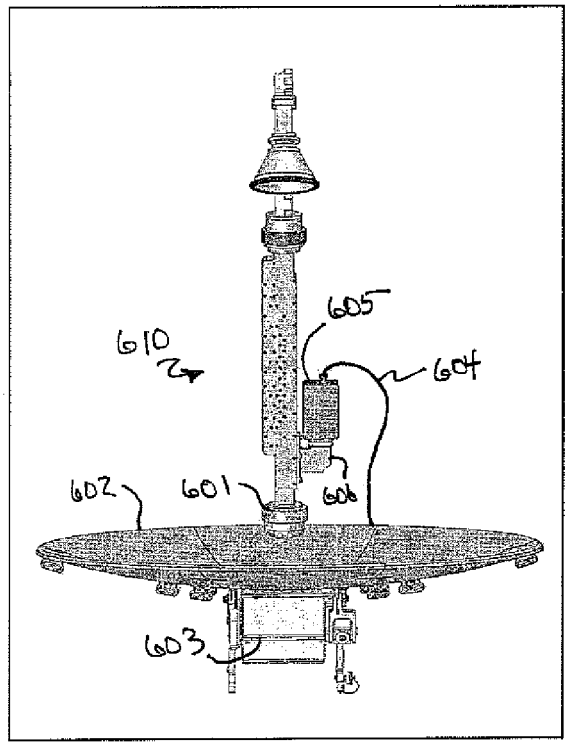
FIG. 6 is a top elevation of an antenna incorporating elements of the invention.

FIG. 6 shows a top view of the antenna, including support arm 610, which is connected to the bottom portion of reflector 602 by means of flange 601, which provides functional continuity between the transmit filter housed within support arm 610 and components of transmitter 603 on the back of the reflector.

Thus, although the antenna components may be assembled as one piece without connectors depending on the application and the specifications, if connectors are used, they are of a type that maintain the continuity and separation of the waveguides.

Also shown in FIG. 6 is LNB 605, which is in communication with the receive filter by means of waveguide bend 606. The receive signal is output from the LNB processing circuitry by coaxial cable 604.

It will be noted from FIG. 6 that the distal portion of the feed arm assembly is clean and un-cluttered relative to the prior art. For instance, the LNB 605 and waveguide bend 606 are moved proximally and away from the exposed distal end of the boom to the more massive base, thereby providing greater protection for these elements and reduced load on the boom. These are additional advantages of integrating the waveguides into a single structure.

Figure 7:
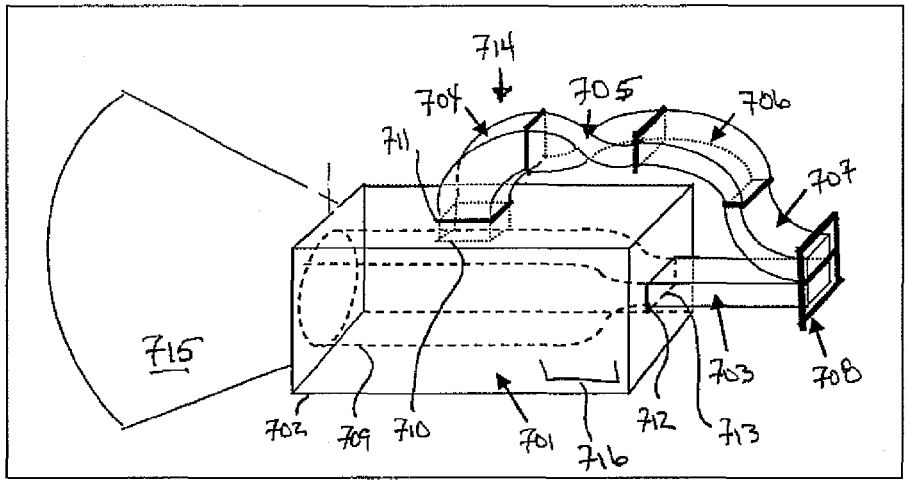
FIG. 7 is a perspective view of a WGI in the form of an OMT with parallel ports.

FIG. 7 shows an embodiment of the invention applicable to linearly polarized signals in which feed horn 715 combined with an OMT 701 as used for linear polarization. The OMT is modified as disclosed herein to act as a WGI, integrating two waveguides into a single structure.

OMT body 702 internally contains a circular waveguide 709 that has a side slot 710 to accommodate a first port 711. The OMT also has a circular-to-rectangular transition 716 terminating in a rectangular end slot 712 to accommodate a second port 713. The second port is continuous with waveguide 703 while the first port is continuous with waveguide 714 formed by bend 704, twist 705 and bends 706 and 707. The proximal ends of waveguide 703 and waveguide 714 are combined to form a square cross-section and they are connected by means of a square-profile flange 708 to the distal end of a waveguide adapter (not shown in FIG. 7), which has a square-cross section that is complimentary to that of the combined ports. Thus, the modified OMT operates as a WGI by integrating the two waveguides into the single waveguide adaptor.

Figure 8:
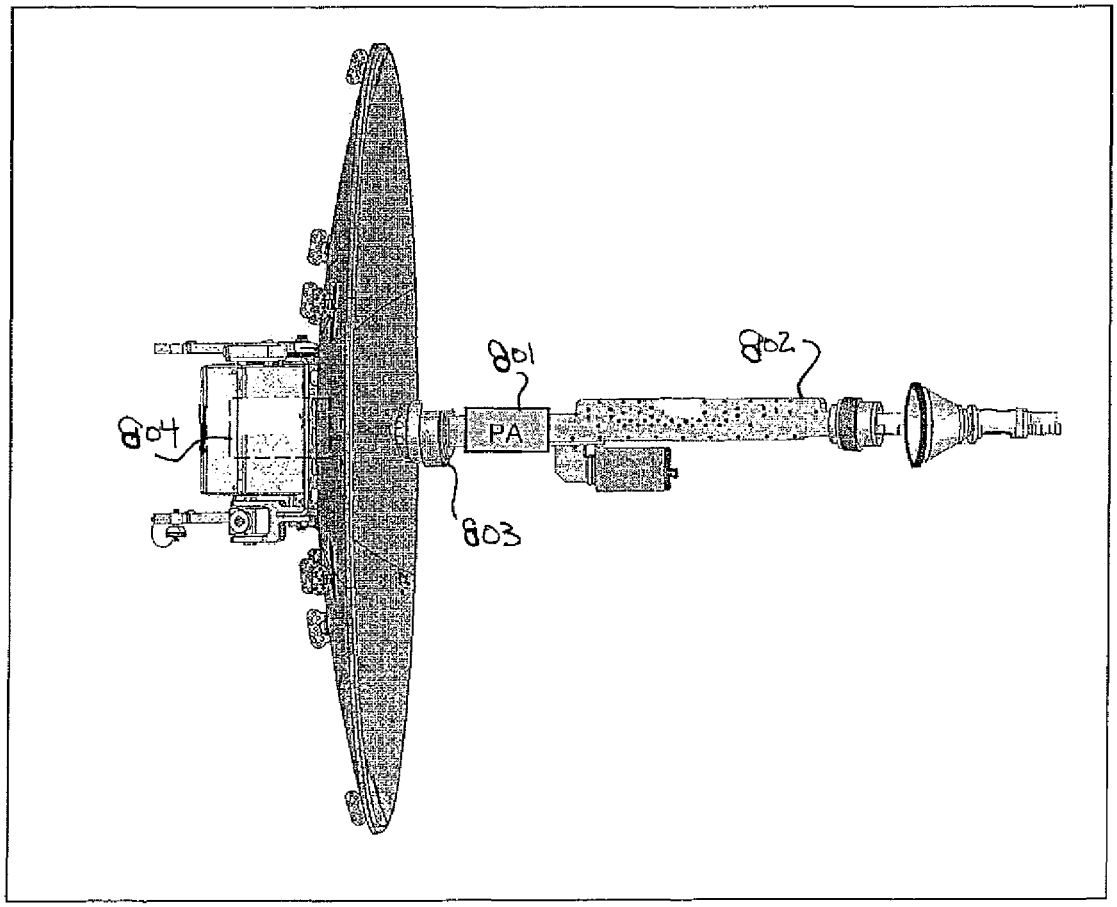
FIG. 8 is a top elevation of an antenna showing the integration of a waveguide power amplifier into the support arm structure.

FIG. 8 shows a preferred embodiment of the invention that can be employed with either circular or linear polarization. A "waveguide style" power amplifier 801 is inserted between the end of the transmit filter in support arm 802 and flange 803. In this position the power amplifier is effectively a continuation or extension of the support arm. With the power amplifier integrated into the support arm, the transmitter components behind the reflector, namely the block-up converter (BUC) 804, can be reduced in size, thereby allowing incorporation of other electronics into its enclosure. The waveguide-style power amplifier as shown features the ability to spatially combine signals into several semiconductor chips, all housed within the waveguide. Amplifiers capable of being adapted in this way are now commercially available, such as the solid state power amplifiers ("SSPAs") manufactured by Wavestream Corporation.

SUMMARY

The benefits of integrating waveguides, filters and other components of support arms and feed assemblies as disclosed and illustrated above include a streamlined, linear package that reduces the weight of the assembly; reduced wind loading on the distal components; increased stability of the antenna including stabilizing antenna "aim", reducing the moment of the support arm by placing the heavy filters close to the reflector, thereby easing the stresses on the elevation adjustment/locking assembly for the reflector. With respect to portable antennas, these improvements enhance portability due to easy assembly/disassembly of the feed and support arm from the reflector as a whole unit.

While this invention has been described with reference to illustrative embodiments, this description is not intended to be construed in a limiting sense. Various novel modifications of the illustrative embodiments, as well as other embodiments of the invention, that are within the scope of the following claims will be apparent to persons skilled in the art upon reference to this description. It is therefore contemplated that any such modifications or embodiments fall within the scope of the claims and their equivalents.

What is claimed is:

1. An antenna comprising:

a. a reflector (602);

b. a base (106), wherein said reflector is connected to said base;

c. a feed assembly (101) comprising:

i. a feed horn (502);

ii. a waveguide integrator a distal end 401A connected to said feed horn, and a proximal end (401B);

d. a support arm (510) having a proximal end, a distal end, at least one internal partition (513), and a transmit filter (509) and a receive filter (516), the transmit filter and receive filter on opposing sides of the internal partition (513), the receive filter and transmit filter joined in parallel; wherein said distal end of said support arm is connected to said proximal end of said waveguide, adapter, and wherein said internal partition of said support arm extends from said proximal end of said support arm to said distal end of said support arm; and, e. a first connector (601) connecting said proximal end of said support arm to at least one of said reflector and said base;

wherein said partition of said support arm and said partition of said waveguide adapter are functionally continuous, whereby at least two separate waveguides are integrated within said waveguide adapter and within said support arm, each waveguide being continuous from said proximal end of said WGI, through said transmit filter, and receive filter, to said proximal end of said support arm.

2. The antenna of claim 1 wherein said distal end of said WGI is oriented toward and in communication with said feed horn, and wherein said proximal end of said WGI is oriented toward and in communication with said distal end of said waveguide adapter.

3. The antenna of claim 1 wherein said WGI comprises a polarizer (401).

4. The antenna of claim 3 wherein said polarizer is a septum polarizer.

5. The antenna of claim 1 wherein said WGI comprises an ortho-mode transducer (OMT) (701).

6. The antenna of claim 5 wherein said OMT comprises a circular-to-rectangular transition.

7. The antenna of claim 1 further comprising a second connector (503, 504), wherein said second connector connects said proximal end of said WGI to said distal end of said waveguide adapter, and wherein said second connector maintains the continuity and separation of said waveguides.

8. The antenna of claim 1 further comprising a third connector (506, 507), wherein said third connector connects said proximal end of said waveguide adapter to said distal end of said support arm, wherein said third connector maintains the continuity and separation of said waveguides.

9. The antenna of claim 1, wherein said WGI further comprises a first port (403) and a second port (404), wherein each of said first port and said second port are in communication with one of the waveguides in the waveguide adapter (505).

10. The antenna of claim 9 wherein said first and said second ports are combined to form a square cross-section and the combined ports have a square cross-section, and share a common flange.

11. A support arm (510) for a satellite, comprising:

a. a proximal end, a distal end, and, at least one internal partition (513), wherein said distal end of said support arm is connected to a proximal end of a waveguide adapter (505), a distal end of said waveguide adapter connected to a waveguide integrator (501), and wherein said internal partition of said support arm extends from said proximal end of said support arm to said distal end of said support arm; and, b. a transmit filter (509) and a receive filter (516), the transmit filter and receive filter on opposing sides of the internal partition (513), the receive filter and transmit filter joined in parallel and having a square profile structure, wherein said partition of said support arm and said partition of said waveguide adapter are functionally continuous, whereby at least two separate waveguides are integrated within said waveguide adapter and within said support arm, each waveguide being continuous from a wave guide integrator, through said transmit filter, and receive filter, to said proximal end of said support arm.

* * * * *

UNITED STATES PATENT AND TRADEMARK OFFICE

CERTIFICATE OF CORRECTION

PATENT NO. : 8,125,400 B2
APPLICATION NO. : 12/271742
DATED : February 28, 2012
INVENTOR(S) : Bezuidenhout et al.

It is certified that error appears in the above-identified patent and that said Letters Patent is hereby corrected as shown below:

Column 6, line 59: after "ii. a waveguide integrator" insert the following:

--(WGI) (401, 501) having--

Column 6, line 61: insert the following:

--iii. a waveguide adapter (505) having a proximal end (505A), a distal end (505B), and at least one internal partition (515), wherein said internal partition extends from said proximal end of said waveguide adapter to said distal end of said waveguide adapter; and,--

Signed and Sealed this
Twenty-ninth Day of May, 2012

David J. Kappos

David J. Kappos
*Director of the United States Patent and Trademark Office*